US007490914B2

(12) United States Patent
Greiner

(10) Patent No.: US 7,490,914 B2
(45) Date of Patent: Feb. 17, 2009

(54) JEWELRY ORGANIZER

(75) Inventor: Lori Greiner, Chicago, IL (US)

(73) Assignee: For Your Ease Only, inc., Chicago, IL (US)

( * ) Notice: Subject to any disclaimer, the term of this patent is extended or adjusted under 35 U.S.C. 154(b) by 0 days.

(21) Appl. No.: 10/375,671

(22) Filed: Feb. 27, 2003

(65) Prior Publication Data

US 2004/0000848 A1 Jan. 1, 2004

Related U.S. Application Data

(62) Division of application No. 10/068,811, filed on Feb. 6, 2002, now abandoned.

(51) Int. Cl.
*E06B 1/00* (2006.01)

(52) U.S. Cl. ..... 312/321.5; 206/6.1

(58) Field of Classification Search ..... 211/85.2; 206/6.1, 235, 823, 566; 312/128, 129, 130, 312/131, 132, 133, 134, 135, 136, 309, 310, 312/311, 321.5, 324, 348.3; 52/36.1, 36.2; D3/901, 903

See application file for complete search history.

(56) References Cited

U.S. PATENT DOCUMENTS

| | | | | | |
|---|---|---|---|---|---|
| 251,337 | A | * | 12/1881 | Burrows | 312/232 |
| 478,584 | A | | 7/1892 | Fraizer | |
| 710,475 | A | * | 10/1902 | Lenzen | 206/560 |
| 937,545 | A | | 10/1909 | Post | |
| 1,012,606 | A | | 12/1911 | Davis | |
| 1,131,713 | A | | 3/1915 | Kramer | |
| 1,133,866 | A | | 3/1915 | Leighty | |
| 1,254,132 | A | * | 1/1918 | Garman | 312/300 |
| 1,369,577 | A | | 2/1921 | Townley | |
| 1,600,830 | A | | 9/1926 | Lewis | |
| 1,975,779 | A | | 1/1934 | Church | |
| 2,268,637 | A | | 1/1942 | Bernstein | |
| 2,286,427 | A | | 6/1942 | Levensten | |
| D152,653 | S | | 2/1949 | Rinehart | |
| 2,513,150 | A | | 6/1950 | Davis | |
| 2,582,812 | A | | 1/1952 | Wise | |
| 2,663,608 | A | | 12/1953 | Schauer | |
| 2,739,697 | A | | 3/1956 | Kuddes | |
| 2,758,904 | A | | 8/1956 | Hansell | |
| 2,995,409 | A | | 8/1961 | Simonsen | |
| 3,078,133 | A | | 2/1963 | Schauer | |
| 3,089,745 | A | * | 5/1963 | Postula et al. | 312/324 |
| 3,353,885 | A | | 11/1967 | Hanson | |
| 3,379,484 | A | | 4/1968 | Kling | |
| D212,661 | S | * | 11/1968 | Gigliuto | D3/275 |
| 3,591,244 | A | | 7/1971 | Hancock, Jr. | |

(Continued)

FOREIGN PATENT DOCUMENTS

DE 19924969 A1 12/2000

(Continued)

*Primary Examiner*—A. Joseph Wujciak, III
(74) *Attorney, Agent, or Firm*—Fredrikson & Byron, P.A.

(57) ABSTRACT

A jewelry organizer for storing jewelry having a plurality of compartments to store jewelry items of various configurations. The jewelry organizer includes pivoting cabinets having earring stands that are slidably received in the cabinets. Drawers are located under the cabinets and have various compartments to hold jewelry items such as bracelets, rings and pins. A pair of doors flanks the drawers and may conceal the drawers when the pair of doors are closed.

40 Claims, 17 Drawing Sheets

U.S. PATENT DOCUMENTS

| | | | | | |
|---|---|---|---|---|---|
| 3,639,022 | A | | 2/1972 | Elmo | |
| 3,664,719 | A | | 5/1972 | Berg | |
| 3,807,572 | A | | 4/1974 | Luvara | |
| 3,813,138 | A | | 5/1974 | Doohan | |
| 3,876,271 | A | | 4/1975 | Skirlock | |
| 3,930,702 | A | | 1/1976 | Pichowicz | |
| 3,997,219 | A | * | 12/1976 | Phelps | 312/234 |
| 4,120,549 | A | | 10/1978 | Bureau | |
| 4,239,308 | A | | 12/1980 | Bradley | |
| 4,324,446 | A | | 4/1982 | LeSage | |
| 4,371,077 | A | | 2/1983 | Solitt et al. | |
| 4,396,121 | A | | 8/1983 | Lemmon | |
| 4,406,372 | A | | 9/1983 | Bell | |
| 4,511,041 | A | | 4/1985 | Waitzman | |
| 4,616,891 | A | | 10/1986 | Jantzen | |
| D289,351 | S | | 4/1987 | Jenkins | |
| 4,717,024 | A | | 1/1988 | Djezovic | |
| 4,765,470 | A | | 8/1988 | Curci | |
| 4,771,206 | A | | 9/1988 | Taylor | |
| 4,776,650 | A | * | 10/1988 | Ferenzi | 312/245 |
| 4,811,996 | A | | 3/1989 | Hansson | |
| 4,850,658 | A | | 7/1989 | Sandor | |
| 4,854,656 | A | | 8/1989 | O'Keefe | |
| 4,874,119 | A | | 10/1989 | Winter | |
| 4,936,463 | A | | 6/1990 | Tiramani | |
| 4,984,854 | A | | 1/1991 | DeLavallade | |
| 4,989,291 | A | | 2/1991 | Parent | |
| D315,460 | S | * | 3/1991 | Sorce, Jr. | D6/469 |
| 5,067,617 | A | | 11/1991 | Caldwell | |
| 5,100,213 | A | * | 3/1992 | Vandarakis et al. | 312/405 |
| D325,123 | S | * | 4/1992 | Tiramani | D3/275 |
| 5,102,209 | A | | 4/1992 | Hesseltine | |
| 5,108,162 | A | | 4/1992 | Lund | |
| 5,117,971 | A | | 6/1992 | Fisher | |
| 5,147,122 | A | * | 9/1992 | Short | 312/321.5 |
| 5,221,132 | A | * | 6/1993 | Combs et al. | 312/310 |
| 5,261,529 | A | | 11/1993 | Holland | |
| 5,358,100 | A | | 10/1994 | Wolff | |
| 5,378,005 | A | | 1/1995 | Norton | |
| D358,708 | S | | 5/1995 | Ko | |
| 5,411,139 | A | | 5/1995 | Victory | |
| D361,430 | S | | 8/1995 | Mohundro | |
| D361,445 | S | * | 8/1995 | Mohundro | D6/440 |
| D363,394 | S | * | 10/1995 | Mohundro | D6/440 |
| D363,395 | S | * | 10/1995 | Mohundro | D6/440 |
| 5,484,092 | A | | 1/1996 | Cheney | |
| 5,511,873 | A | | 4/1996 | Mech | |
| 5,558,418 | A | | 9/1996 | Lambright et al. | |
| 5,607,215 | A | | 3/1997 | Pacetti | |
| D383,012 | S | * | 9/1997 | Mohundro | D6/439 |
| 5,685,624 | A | | 11/1997 | Lee | |
| 5,690,401 | A | | 11/1997 | Franklin | |
| 5,692,605 | A | | 12/1997 | Lai | |
| 5,740,910 | A | | 4/1998 | Ueng | |
| 5,762,184 | A | | 6/1998 | Greiner | |
| 5,765,239 | A | * | 6/1998 | Moses | 5/2.1 |
| D403,530 | S | * | 1/1999 | Lin | D6/445 |
| 5,941,255 | A | | 8/1999 | Chen | |
| 6,045,202 | A | | 4/2000 | Simon | |
| 6,158,578 | A | | 12/2000 | Greiner | |
| 6,595,609 | B1 | * | 7/2003 | Greiner | 312/321.5 |
| D485,682 | S | * | 1/2004 | Wolf | D3/295 |
| 6,857,519 | B2 | | 2/2005 | Daetweiler | |
| 7,052,098 | B1 | * | 5/2006 | Greiner | 312/321.5 |
| 7,182,416 | B1 | * | 2/2007 | Greiner | 312/321.5 |
| 2002/0117945 | A1 | | 8/2002 | Norman et al. | |

FOREIGN PATENT DOCUMENTS

| | | | |
|---|---|---|---|
| FR | 940540 | | 12/1948 |
| GB | 287249 | | 3/1928 |
| GB | 2205225 | A | 12/1988 |
| GB | 2 217 298 | | 10/1989 |
| GB | 2 273 649 | | 6/1994 |
| GB | 2345630 | | 7/2000 |
| JP | 2000-197530 | | 7/2000 |
| WO | 99/00005 | | 1/1999 |

* cited by examiner

JEWELRY ORGANIZER

This is a request for filing a Divisional application, under 37 C.F.R. § 1.53(b), of prior application Ser. No. 10/068,811, filed Feb. 6, 2002 now abandoned, for: JEWELRY ORGANIZER by: Lori Greiner. The entire disclosure of the prior application is considered as being part of the disclosure of the accompanying application and is hereby incorporated by reference therein.

RELATED APPLICATION

The present application is related to U.S. patent application Ser. No. 09/728,505, entitled "Jewelry Chest and Box with Slidable Features" filed Dec. 1, 2000, incorporated herein by reference.

FIELD OF THE INVENTION

The present invention relates to a jewelry organizer with unique slidable features. While several different types of jewelry organizers are known, there is a need for a jewelry organizer that is convenient to use and allows a user to easily view and select jewelry.

BACKGROUND OF THE INVENTION

One type of a known jewelry holder is in the form of a container with relatively high sides and back walls and a top that is hinged to the back wall to permit access into the container. Earring stands are fixed to the bottom of the container. A particular problem with this type of jewelry holder is that it is very difficult to insert and remove the jewelry from the stands because the side walls and hinged top limit the amount of space available.

Yet another type of jewelry holder proposes racks that slide into a box-like container having a single open side. Again, a problem with this type of jewelry holder is that because the racks are designed as an integral part of the box-like container when the racks are removed from the container, the racks cannot be placed on a horizontal surface without falling over. In addition, because there is only one open side, access to the jewelry located inside the container is limited.

U.S. Pat. No. 5,762,184, invented by the present inventor and hereby incorporated by reference discloses a jewelry holder with a plurality of movable earring stands that are positioned on a base. The base is in the form of a box with an open front that slidably receives a drawer. The top of the base is provided with a plurality of grooves that slidably receive the earring stands. The stands include a pair of supports joined by a substantially horizontal cross-piece that has at least one aperture sized to receive a post or stem of an earring. The stands include a base that is sized to slidably fit within the grooves in the base. Alternatively, clip-on earrings may be directly clipped onto the crosspiece.

Some organizers are in the form of a piece of furniture, such as an armoire. These types of organizers can hold many more jewelry items as well as other items such as lingerie, evening bags, etc. These organizers may have drawers, some having compartments within the drawers to organize jewelry items. In addition, these items may have side doors outfitted with necklace bars for holding necklaces.

It is desirable to provide a jewelry organizer that can hold a large amount of jewelry in an organized fashion that allows a user to have direct and easy access to the jewelry contained therein. In addition, it is desirable to provide a jewelry organizer that makes visual inspection of the items contained therein easy. In addition, it is desirable to provide a jewelry organizer that groups like items together.

DETAILED DESCRIPTION OF THE PREFERRED EMBODIMENTS

Figure 1:
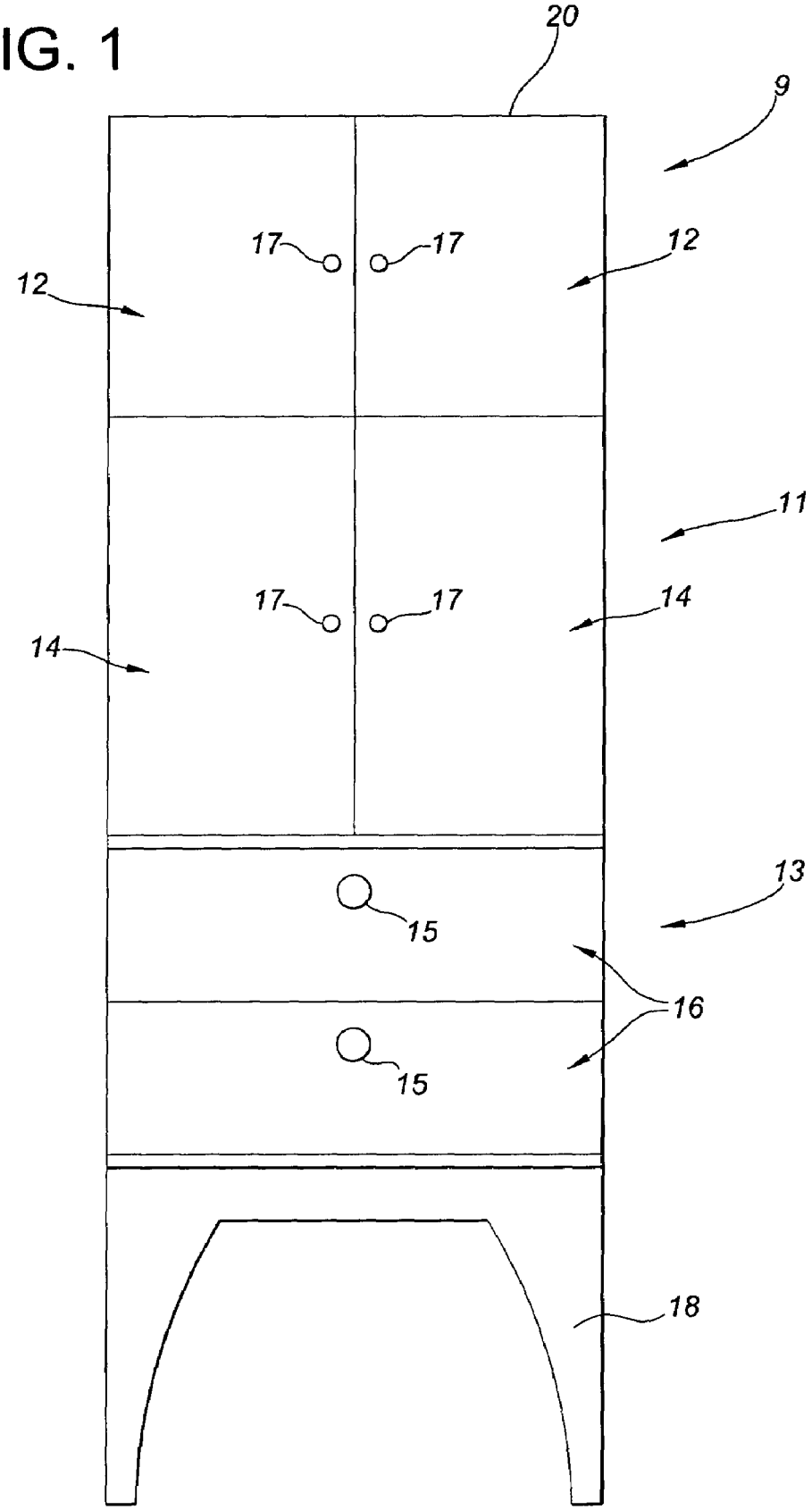
FIG. 1 is a front elevational view of a jewelry organizer according to a first preferred embodiment of the present invention.

FIG. 1 is a front elevational view of a jewelry organizer according to a first preferred embodiment of the invention. The jewelry organizer 10 has a top section 9, a middle section 11 and a bottom section 13. The top section 9 includes two doors 12. The middle section 11 includes two mid-level doors 14 and the bottom section 13 includes a plurality of drawers 16. While there are only two drawers 16 illustrated in the bottom section 13, there may be more or less and the present invention is not limited to the particular embodiments illustrated. The bottom section 13 may include legs 18 as shown or, alternatively, the bottom section 13 of the organizer 10 may be a chest of drawers that extend to the floor. The organizer 10 has a lid 20 that can be pivoted open to expose a mirror as will be described hereinafter. Pull handles 15 and/or knobs 17 are included on the drawers 16 and/or doors 12, 14 respectively. In a preferred embodiment, the top, middle and bottom sections 9-13 are detachable from one another. In another preferred embodiment, the top, middle and bottom sections 9-13 are not detachable from one another. In still another preferred embodiment, only certain sections may be detachable from one another.

Figure 2:
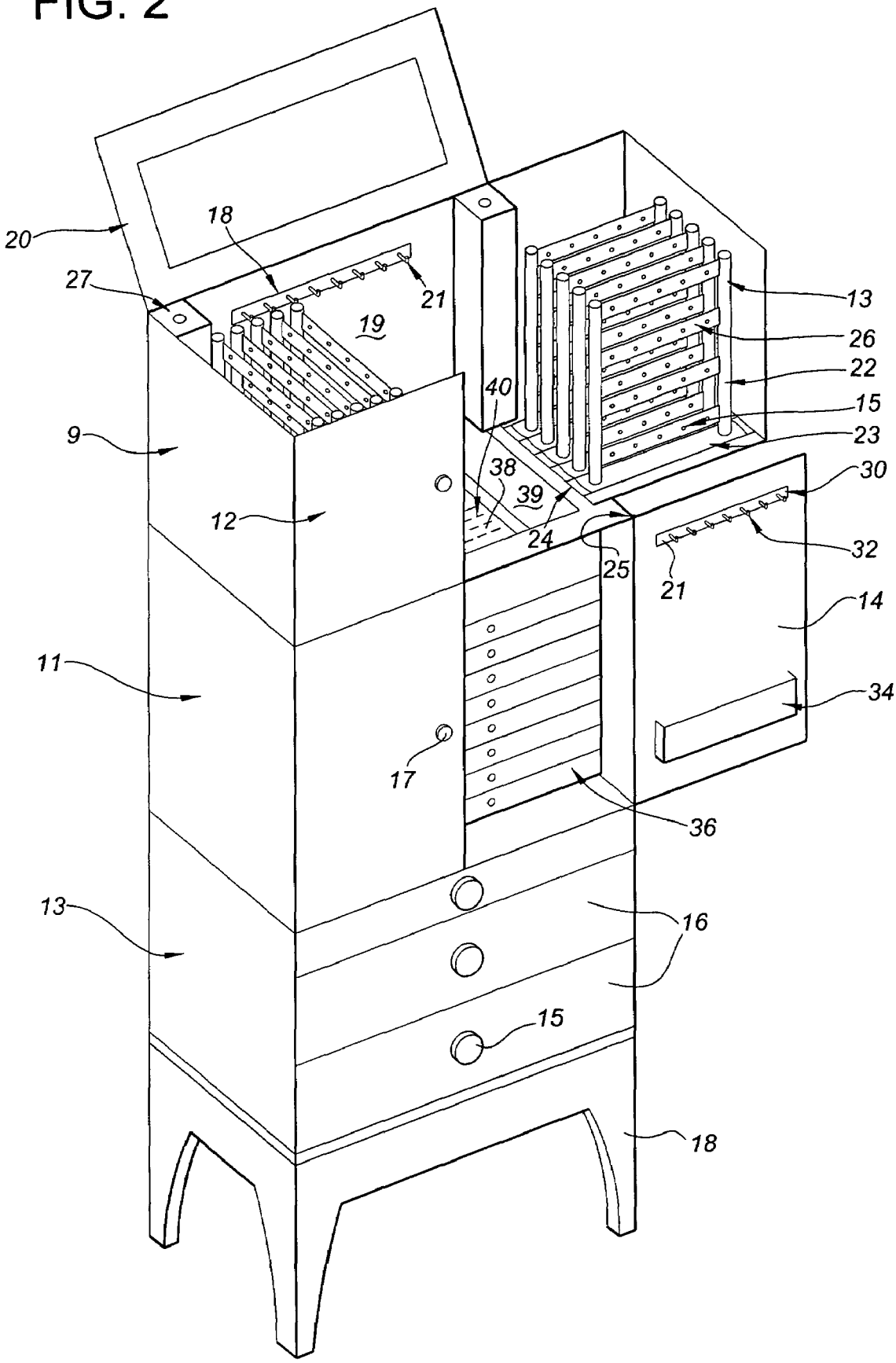
FIG. 2 is a perspective view of the jewelry organizer shown in FIG. 1 with two doors and a lid opened.

FIG. 2 is a perspective view of the jewelry organizer shown in FIG. 1 with one of the top doors 12 and mid-level doors 14 opened as well as the lid 20. The jewelry organizer 10 has a back wall 19 with a necklace bar 18 secured thereto. The necklace bar 18 has a plurality of hooks 21 on which necklaces can be hung. The doors 12 each form a cabinet as can be seen in FIG. 2 in which a plurality of sliding earring stands 22 are mounted. More particularly, the sliding earring stands 22 can be slid out of the cabinet formed in the door 12. Each sliding earring stand 22 is mounted within the cabinet in grooves/tracks 24 formed in the bottom of the cabinet. U.S. Pat. No. 5,762,184 entitled "Jewelry Holder with at Least One Movable Stand", by the present inventor which is incorporated herein by reference, discloses sliding earring stands that are the same as those incorporated into the doors 12. The sliding earring stands 22 each have a plurality of crosspieces 26 extending between pillars 13. Each cross piece 26 has a plurality of holes 15 in which pierced earrings can be mounted. In addition, clip on earrings can be mounted directly to the crosspiece 26. The sliding earring stands 22 have a base 23 that fits within a groove 24 and thus, when a stand 22 is removed from the cabinet, it is self-supporting, in other words the earring stands 22 can stand on their own on a relatively flat surface when removed from the grooves or tracks 24 formed in the floor of each cabinet.

The drawers 16 have pull handles 15 which allow the user to slide a drawer 16 in and out of the organizer 10. The doors 12 in the top section 9 of the organizer are rotatably secured in the organizer by hinges 27. The doors 14 in the middle section 11 of the organizer are mounted to the organizer by hinges 25. Located on the inside of each door 14 is another necklace bar 30 with a plurality of hooks 32 on which necklaces can be hung. The necklace bar 30 can be unhinged by releasing a clasp 21 and the necklace bar 30 can be rotated away from the door 14. Alternatively, the necklace bar 30 can be fixed to the door 14. Each door 14 may also be provided with a tray 34 to hold the bottom portion of long necklaces so that the necklaces do not interfere with the closing of the doors 14.

Behind the doors 14 are a plurality of drawers 36. Storage compartments such as a ring platform 38 can be placed in a drawer. The ring platform 38 is preferably a soft, foam-like material in which slits 40 are formed as is well known. The other drawers 36 may also hold rings or they may have compartments to hold larger items such as bracelets, brooches and necklaces. In addition, they may hold articles of clothing such as scarves, lingerie, socks and hosiery. The drawers 36 can be customized by forming the storage compartments as stand alone units which can be interchangeable and/or dropped into a drawer according to a user's needs and preferences. In addition, removable dividers may be provided to allow a user to customize the configuration of the storage compartment of each drawer 36. Alternatively, the storage compartments may be formed as an integral part of the drawer and not changeable by the user.

As can be seen from FIG. 1 when the doors 14 are closed, they conceal the plurality of drawers 36 located behind them.

In the preferred embodiment shown in FIG. 2, the top 39 of the middle section 11 is substantially open so that one can see items in the top-most drawer 36 of the middle section 11. Alternatively, the top 39 may be closed.

Figure 3:
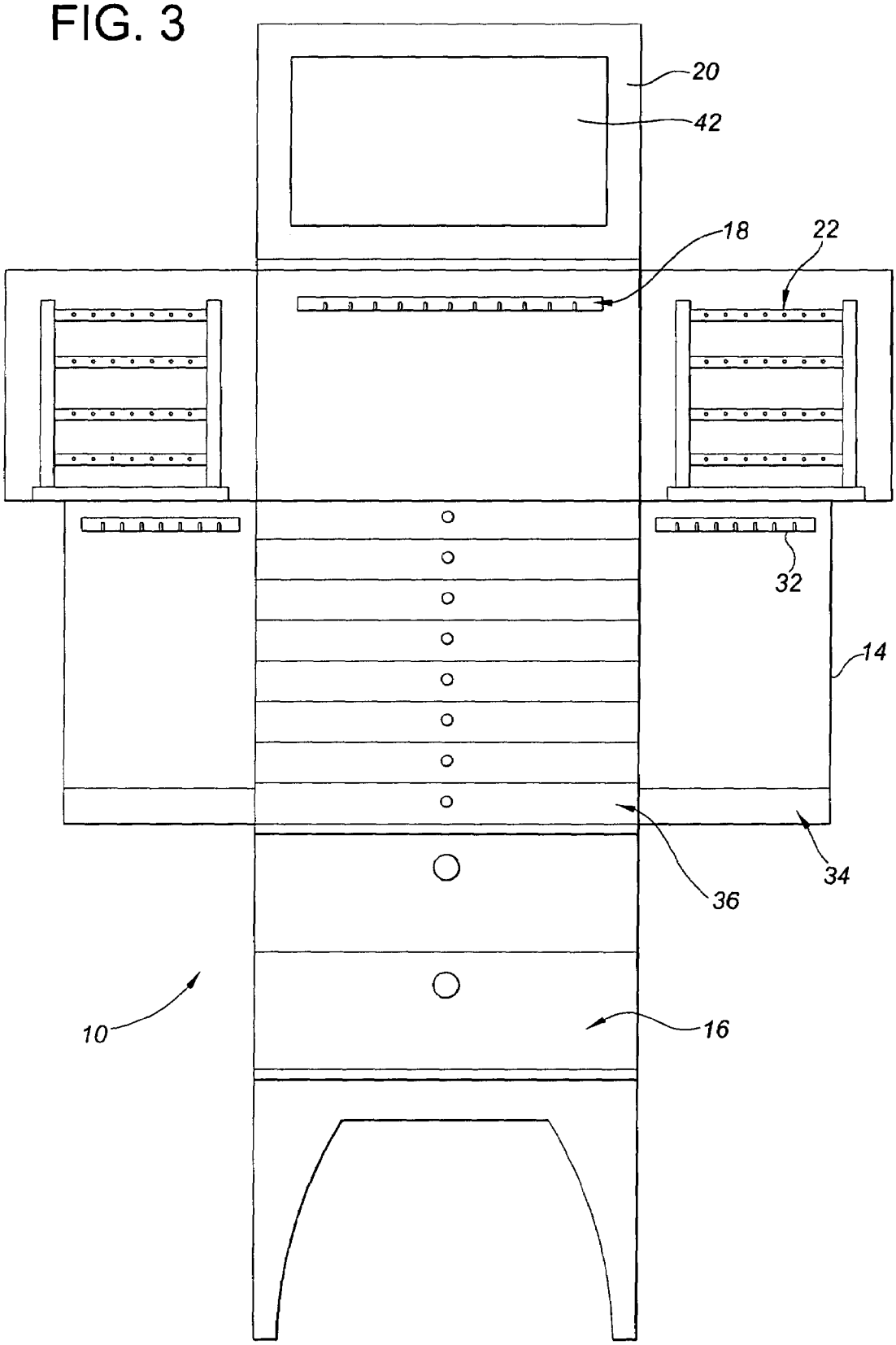
FIG. 3 is a front elevational view of the jewelry organizer shown in FIG. 1 with all the doors and lid opened.
Figure 4:
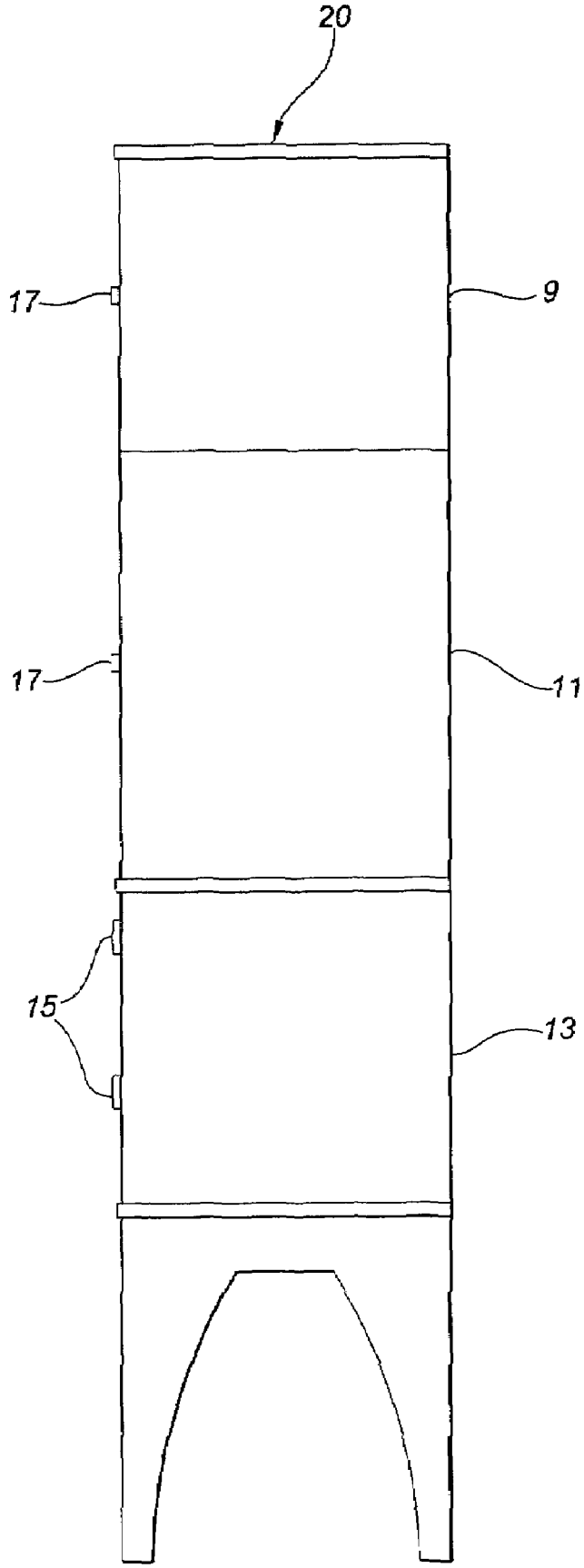
FIG. 4 is a side view of the jewelry organizer shown in FIG. 1.
Figure 7:
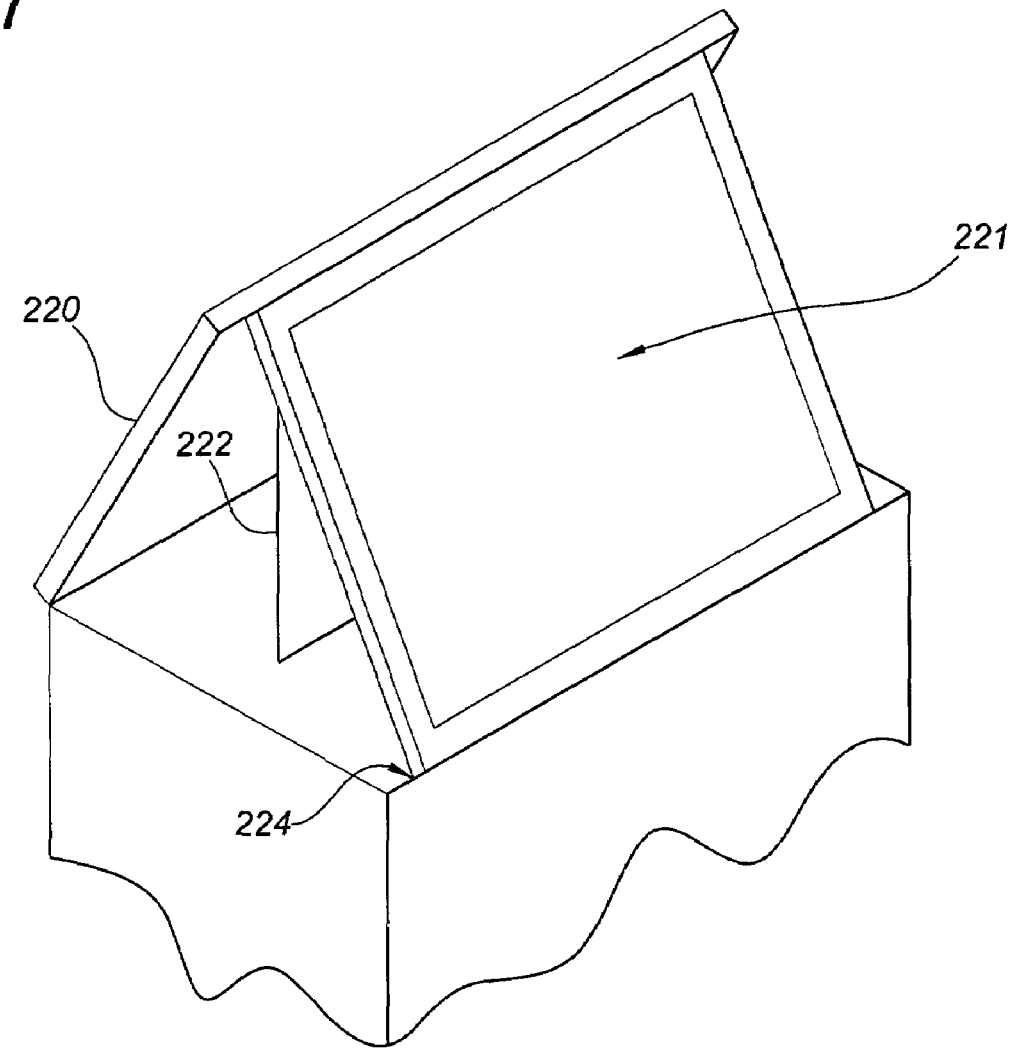
FIG. 7 is a perspective view of a portion of a jewelry organizer according to another preferred embodiment of the present invention.

FIG. 3 is a front elevational view of the jewelry organizer 10 shown in FIG. 1 with all the doors 12, 14 and lid 20 opened. A mirror 42 is located on the inside of lid 20. Alternatively, the top of the organizer 10 may be provided with a recessed opening, and upon opening the lid 20, the mirror can be propped up and supported by an easel as shown in FIG. 7. Alternatively, the organizer may be provided without a pivoting lid. FIG. 4 is a side view of the jewelry organizer 10 shown in FIG. 1.

The walls and floors of the various compartments and the lid's inner surface of the jewelry organizer are preferably lined with an anti-tarnish cloth many varieties of which are commercially available. The anti-tarnish cloth allows the jewelry to be placed in the organizer 10 while reducing the risk of tarnish to the jewelry items. Alternatively, only sections of the organizer may be lined with anti-tarnish cloth, or there may be no anti-tarnish cloth provided.

In a preferred embodiment, the jewelry organizer is formed of wood and is about eighteen inches wide, forty-eight inches high and about fourteen inches deep. Of course, the preferred embodiment of the chest is not limited in size and other dimensions may be used depending on the quantity of jewelry to be held. Alternatively, the chest can be made of various other materials such as acrylic, polystyrene, polypropylene, metal, and wood composites, for example.

Figure 5:
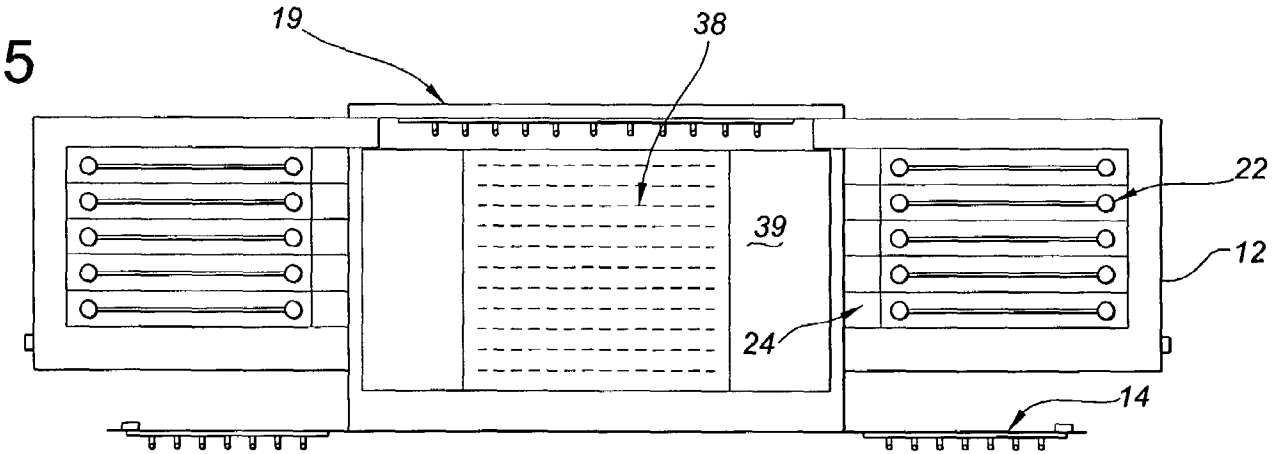
FIG. 5 is a top view of the jewelry organizer as shown in FIG. 1 with all of the doors opened and the lid opened.

FIG. 5 is a top view of the jewelry organizer shown in FIG. 1 with all of the doors 12, 14 and the lid 20 opened.

Figure 6:
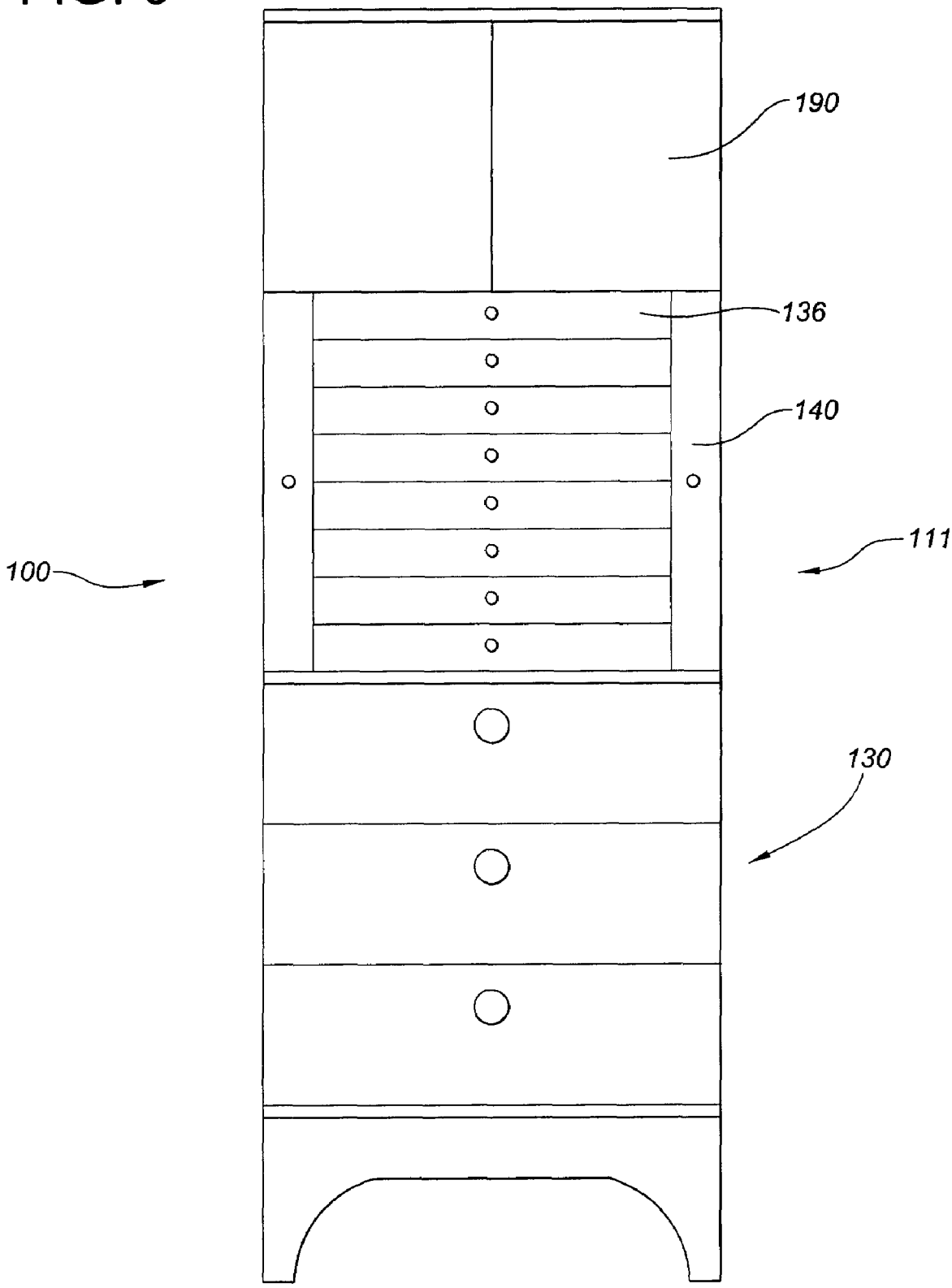
FIG. 6 is a front elevational view of a jewelry organizer according to another preferred embodiment of the present invention.

FIG. 6 is a front elevational view of a jewelry organizer 100 according to another preferred embodiment of the present invention. In this preferred embodiment, the doors 140 which house necklaces are mounted on the side of the organizer 100. Unlike the preferred embodiment shown in FIGS. 1-5, the drawers 136 are exposed in this preferred embodiment. The bottom section 130 is a chest of drawers in this preferred embodiment.

Because the bottom sections 13, 130 of the organizers 10, 100 shown in FIGS. 1 and 6 are detachable from the middle sections 11, 111, the organizer can be modified to a user's needs. Thus, a user may decide that more space is necessary and choose the bottom section 140 shown in FIG. 6 to be used with either middle section 11, 111. In addition, because the top sections 9, 190 of the organizers 10, 100 shown in FIGS. 1 and 6 are also detachable from the middle sections 11, 111, the top portions 9, 90 can be removed from the organizer and placed on a surface such as a vanity counter if desired. In addition, a user can select from a plurality of top sections such as that shown in FIGS. 1-7 and FIGS. 10-15. The inner surface of each door 140 is provided with a necklace bar and tray as previously described. Of course, the organizers 10, 100 shown in FIGS. 1-6 may be a single, unitary piece or they may be detachable from one another.

FIG. 7 is a perspective view of another embodiment of a lid 220 that may be used with any of the jewelry organizers described herein. In this preferred embodiment, the lid 220 pivots open as shown. A mirror 221 is located under the lid 220 and is rotatably attached to the organizer at its lower edge 224. An easel-like stand 222 located behind the mirror 221 prop the mirror into position as shown.

Figure 8:
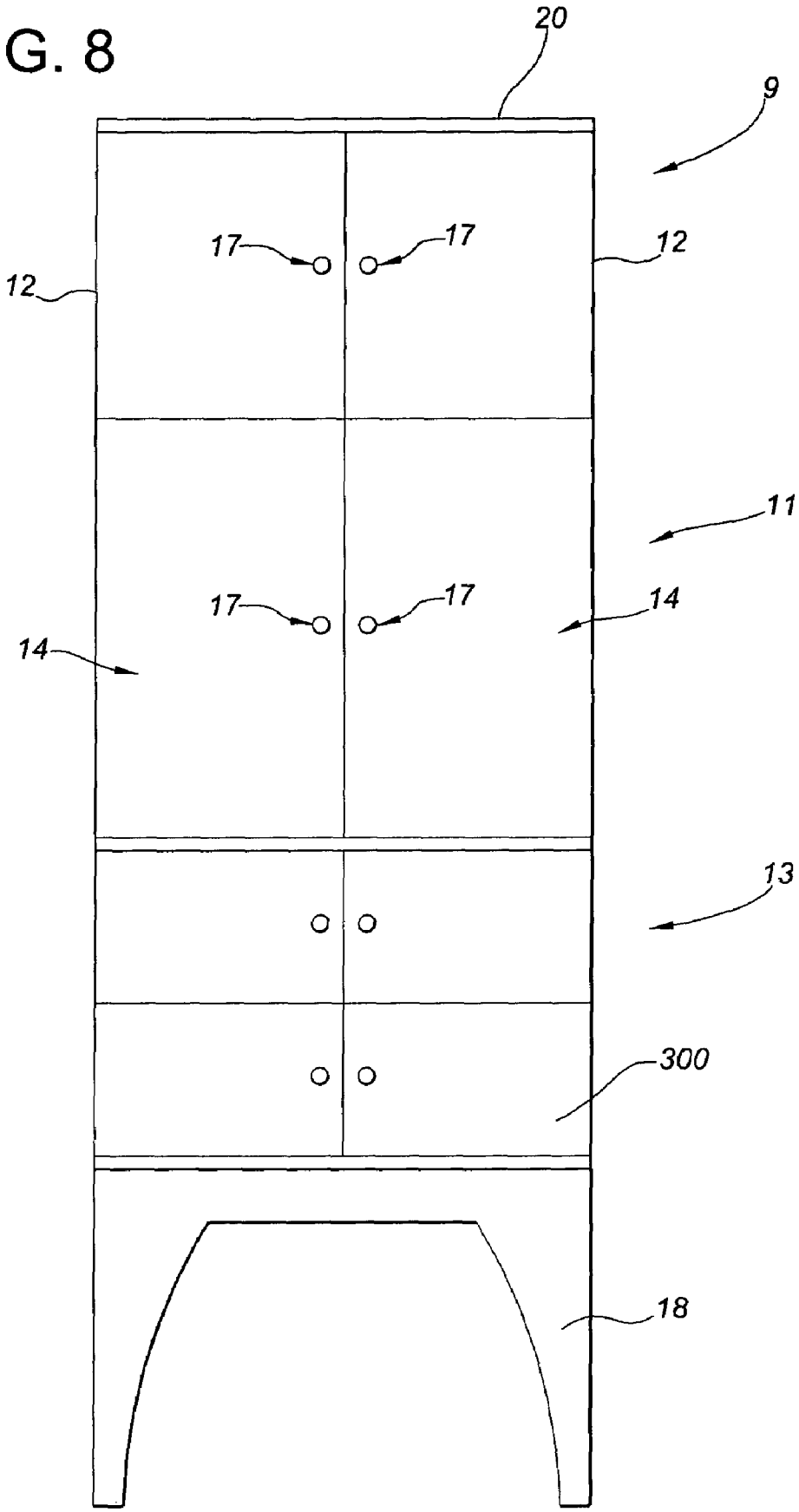
FIG. 8 is an elevational view of a jewelry organizer according to another preferred embodiment of the present invention.

FIG. 8 is a front elevational view of another preferred embodiment of a jewelry organizer. In this preferred embodiment, some of the drawers are replaced with pivotal trays 300 that rotate out as shown by the arrow as disclosed in U.S. Ser. No. 09/728,505 which is hereby incorporated in its entirety by reference. In addition, the bottom section 13 of the organizer may be provided with both pivoting trays and pull-out drawers.

Figure 9:
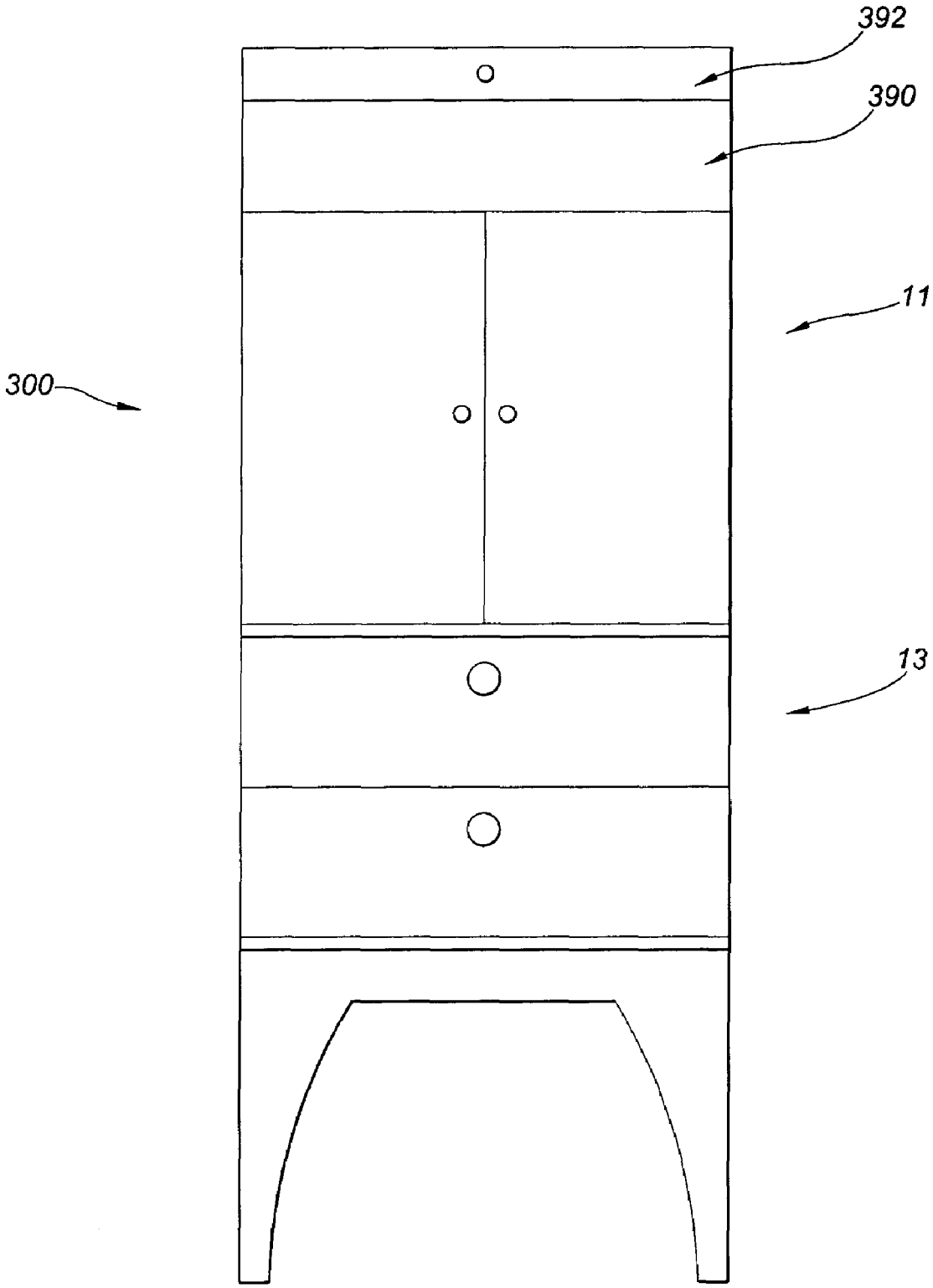
FIG. 9 is a front elevational view of a jewelry organizer according to another preferred embodiment of the present invention.
Figure 10:
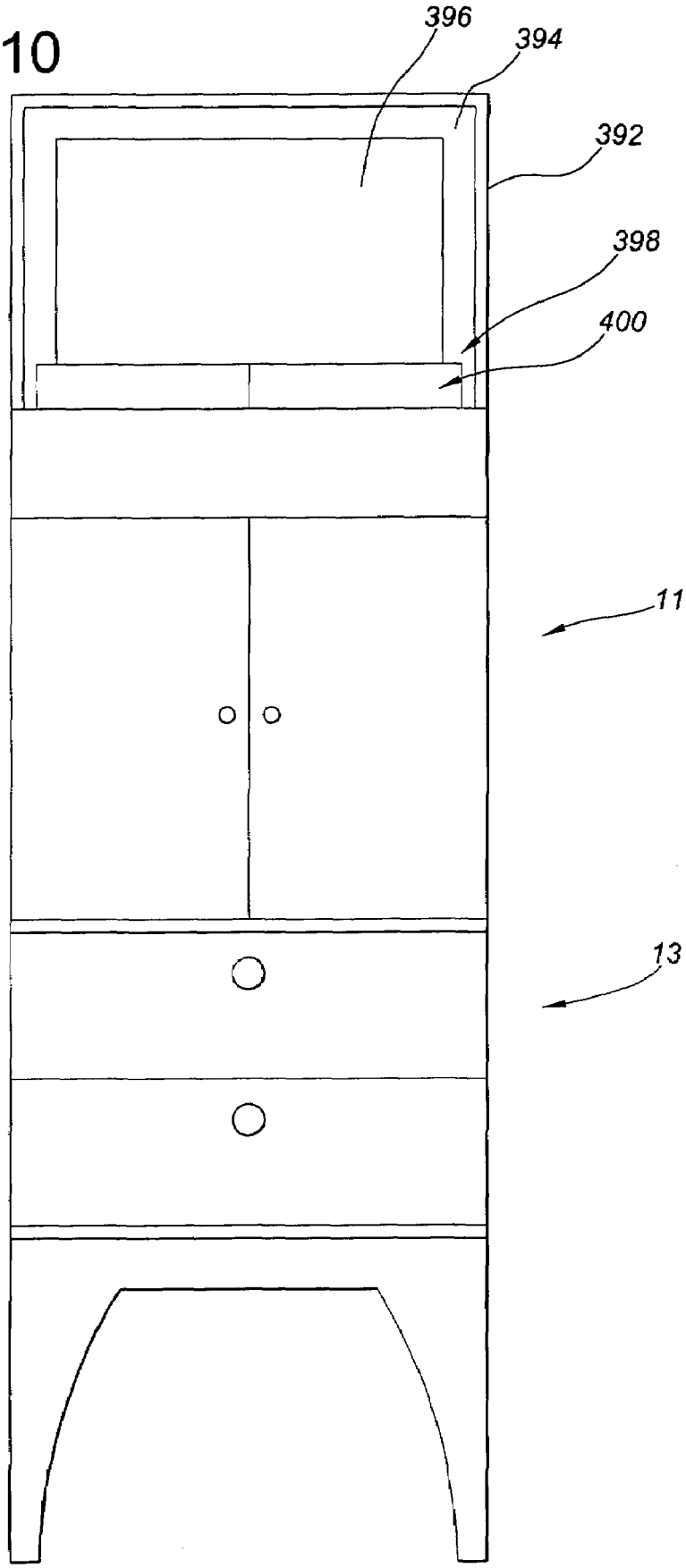
FIG. 10 is the organizer shown in FIG. 9 with the top lid opened.

FIG. 9 is a front view of a jewelry organizer 300 according to another preferred embodiment of the present invention. In this embodiment the middle and lower sections 11, 13 are the same as shown in FIGS. 1-5 but the top section 390 is different. The top section 390 includes a lid 392 which can be pivoted open as shown in FIG. 10. The inner surface 394 of the lid 392 may have a mirror 396 disposed thereon as shown or it may not. Located under the lid is a compartment 398 that holds a plurality of lift out drawers 400 as shown in FIG. 11.

Figure 11:
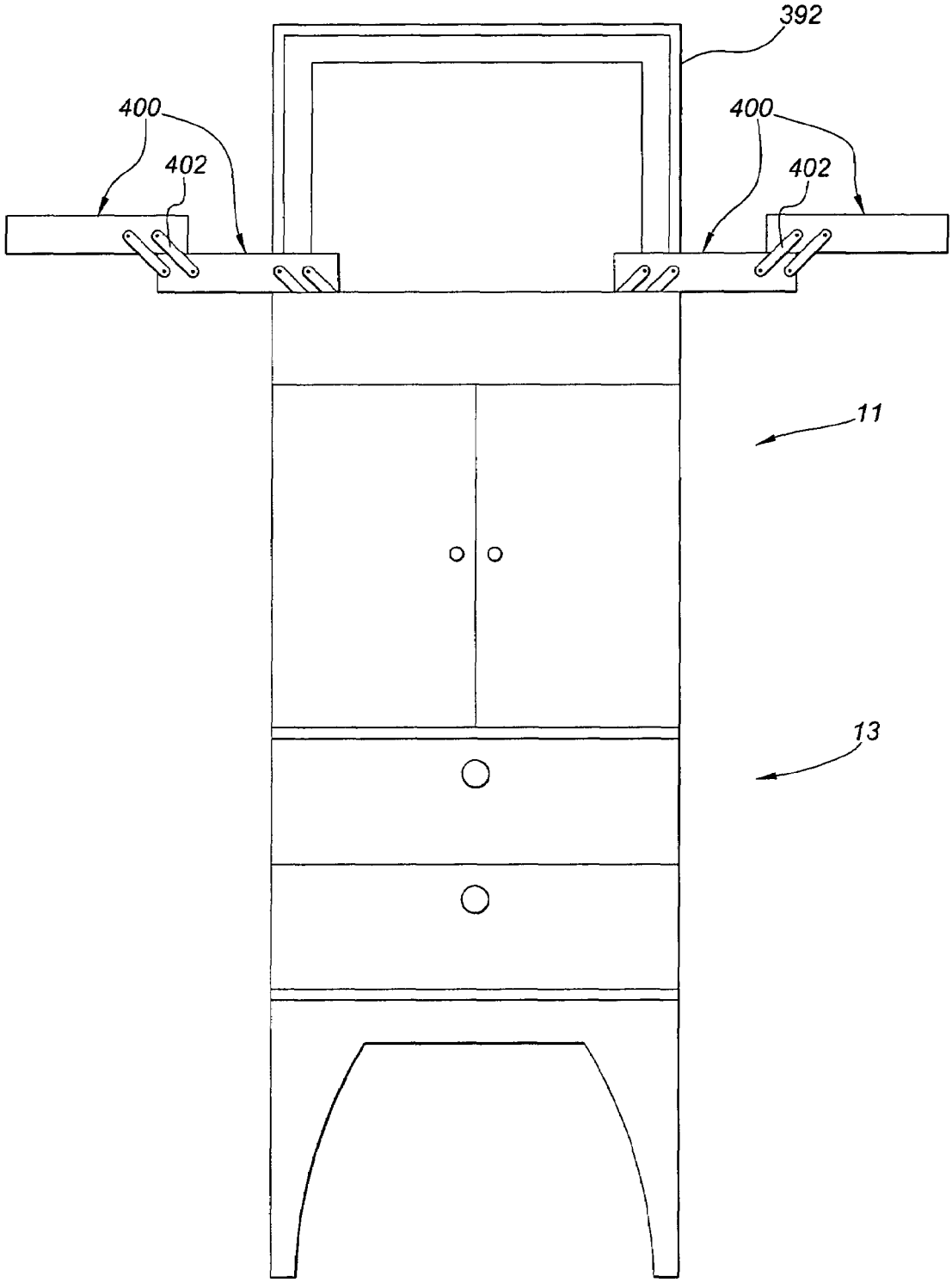
FIG. 11 is the organizer shown in FIG. 9 with the top lid opened and the lift out drawers fully extended.
Figure 12:
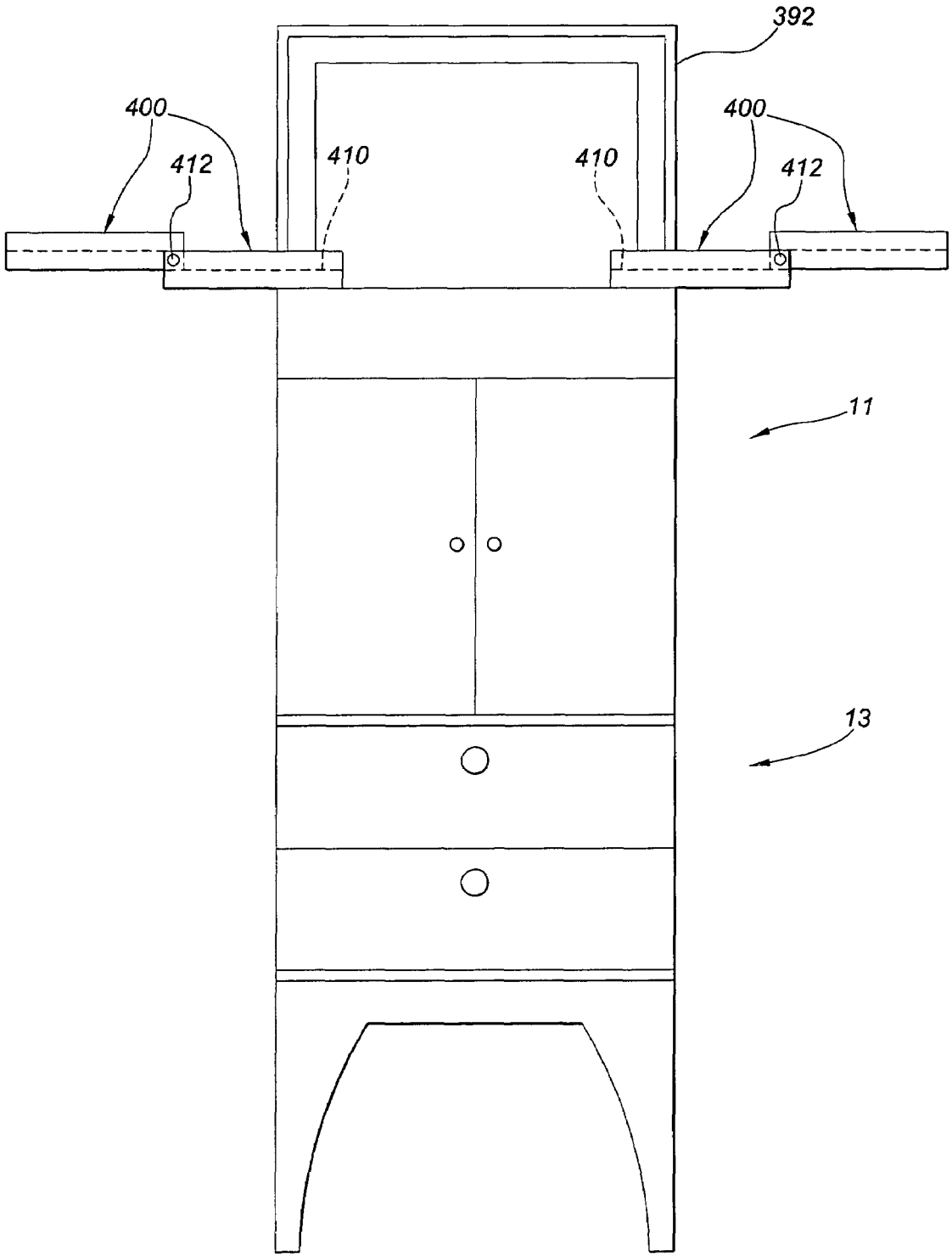
FIG. 12 is an elevational view of an organizer according to another preferred embodiment of the present invention.

In one preferred embodiment, the lift out drawers 400 are coupled to one another by hinges 402 such that the drawers 400 can be lifted out of the compartment 398 and fully extended as shown in FIG. 11. Alternatively, the upper drawers 400 can slide along a track 410 formed in the bottom most drawers 400 as shown in FIG. 12. Wheels 412 may also be added to assist in the sliding of the drawers. Of course, if more drawers were provided additional tracks would be needed. In addition, as shown in the embodiment shown in FIG. 12, the lower-most drawers 410 may slide along the top of the middle section to their extended position as shown in FIG. 12 and not be lifted-out as shown in FIG. 11. Alternatively, the lower-most drawers 410 may lift out and the drawers located thereabove may slide out from the lower-most drawers.

Figure 13:
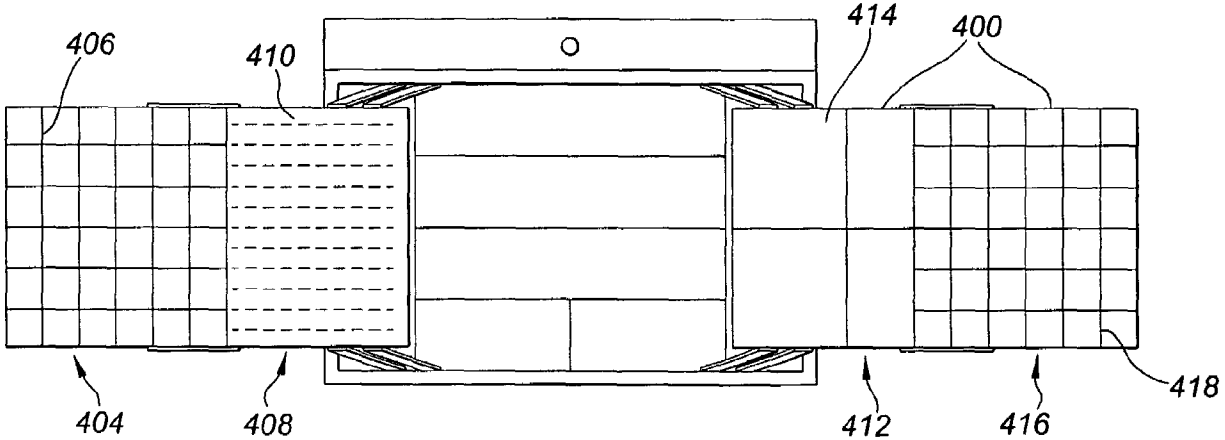
FIG. 13 is a top view of the organizer shown in FIG. 9 with the top lid opened and the lift out drawers fully extended.

FIG. 13 is a top view of the jewelry organizer shown in FIG. 11. Each drawer 400 can be customized for a user's particular needs. As an example, a first drawer 404 may have a plurality of adjustable dividers 406 located therein to provide maximum earring storage. A second drawer 408 may have a ring platform 410 located therein. The ring platform 410 may be a piece of foam covered with fabric and die cut with slits to hold rings upright. A third drawer 412 holds a plurality of adjustable dividers 414 that divide the drawer 412 into larger compartments than drawer 404. Like the dividers 406 in drawer 404, the dividers 414 are removable and/or interchangeable. The fourth drawer 416 includes a plurality of adjustable dividers 418 that divide the drawer 416 into medium sized compartments. The dividers 418 in the fourth drawer 416 are also removable and/or interchangeable. All of the lift out drawers 400 are configurable to a user's needs.

Figure 14:
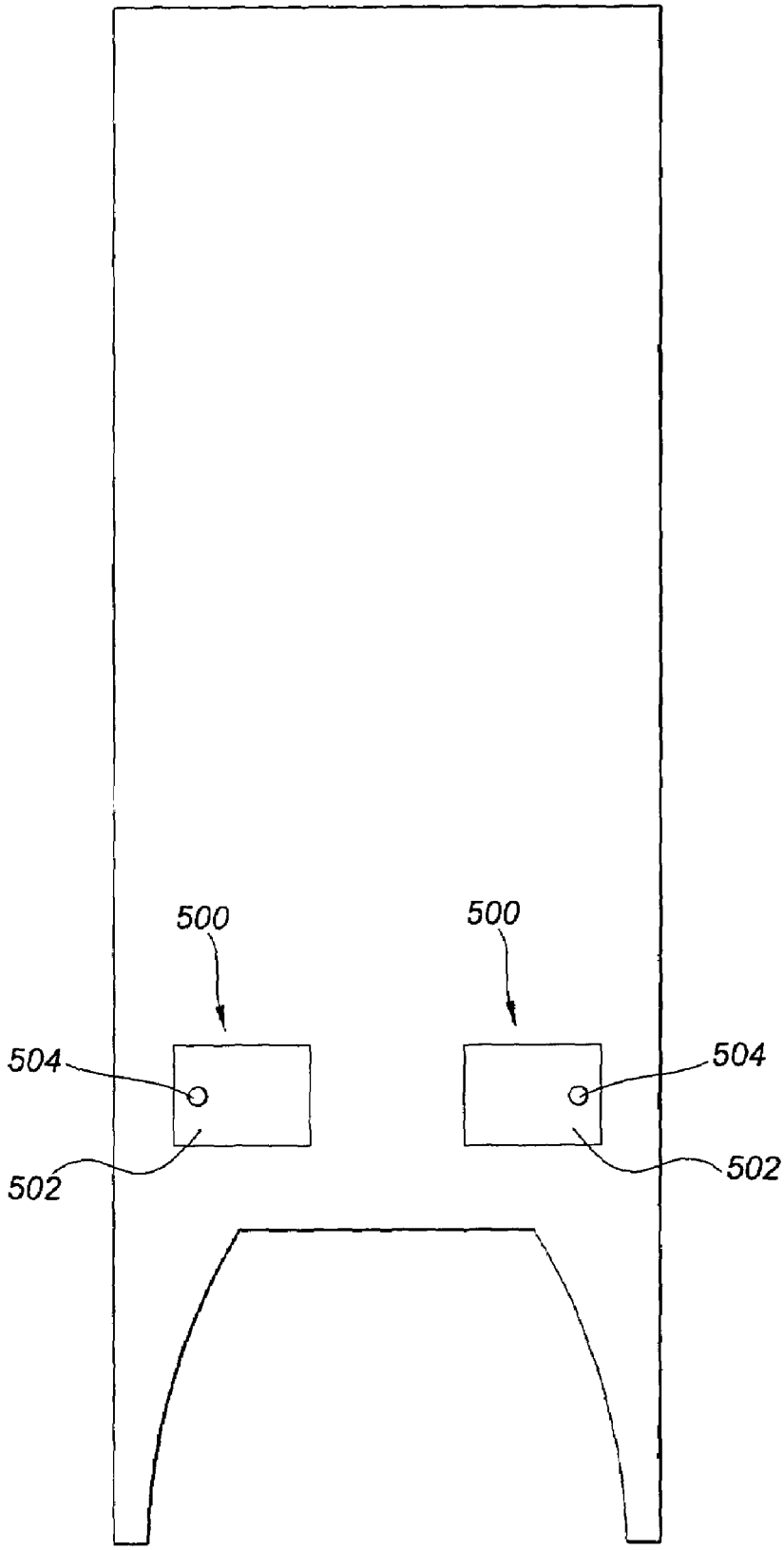
FIG. 14 is an elevational view of the back of a jewelry organizer according to another preferred embodiment of the present invention.
Figure 15:
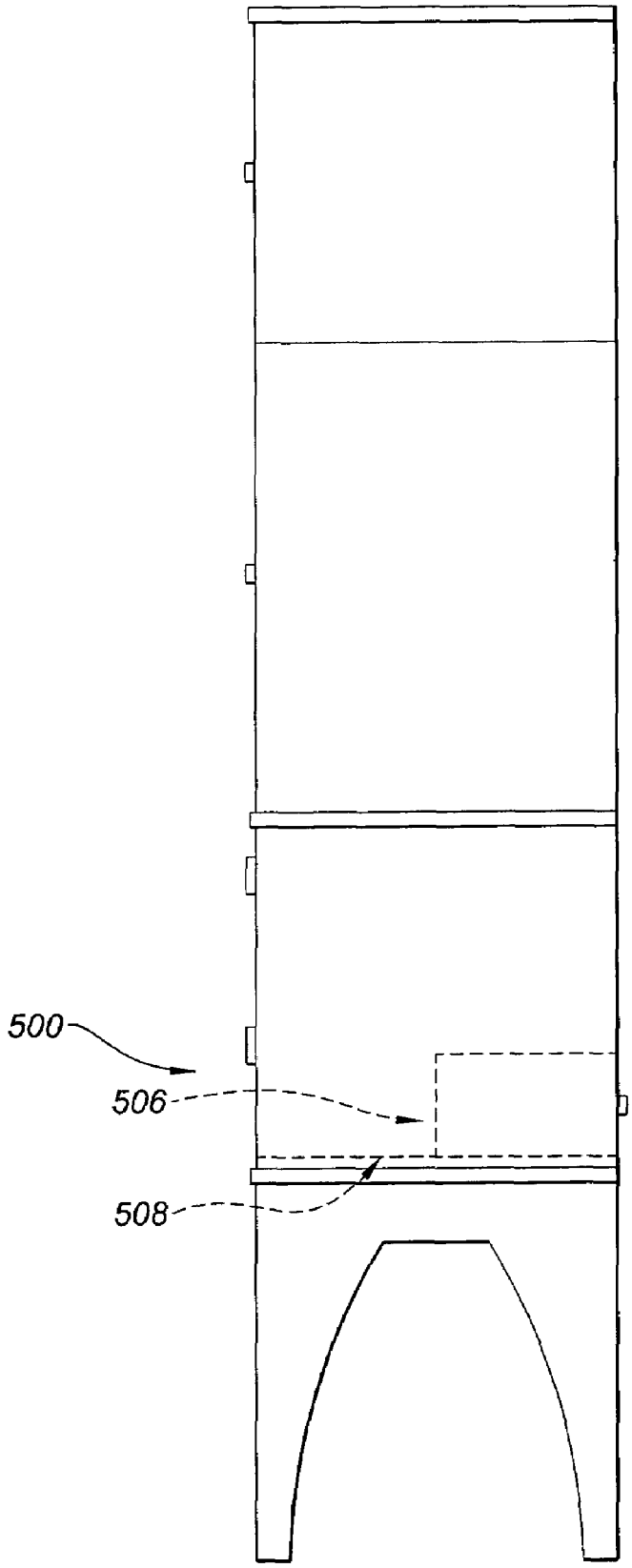
FIG. 15 is a side view of the jewelry organizer shown in FIG. 14.

FIG. 14 is an elevational view of the back of a jewelry organizer according to a preferred embodiment of the present invention. Two secret compartments 500 are provided although the present invention is not limited to a particular number of such compartments. A door 502 is provided to gain access to the compartment 500. Each door 502 may be provided with a lock 504 or a combination (not shown) to provide security. In addition, the other drawers, doors and trays may be provided with latches or locks or other security devices. As can be seen in the side view of the organizer in FIG. 15, the compartment 500 is provided by utilizing a shorter drawer 510 which slides on a platform 508, such as a three-quarters length drawer, so that a region directly behind the drawer is vacant and can be used as the secret compartment.

Figure 16:
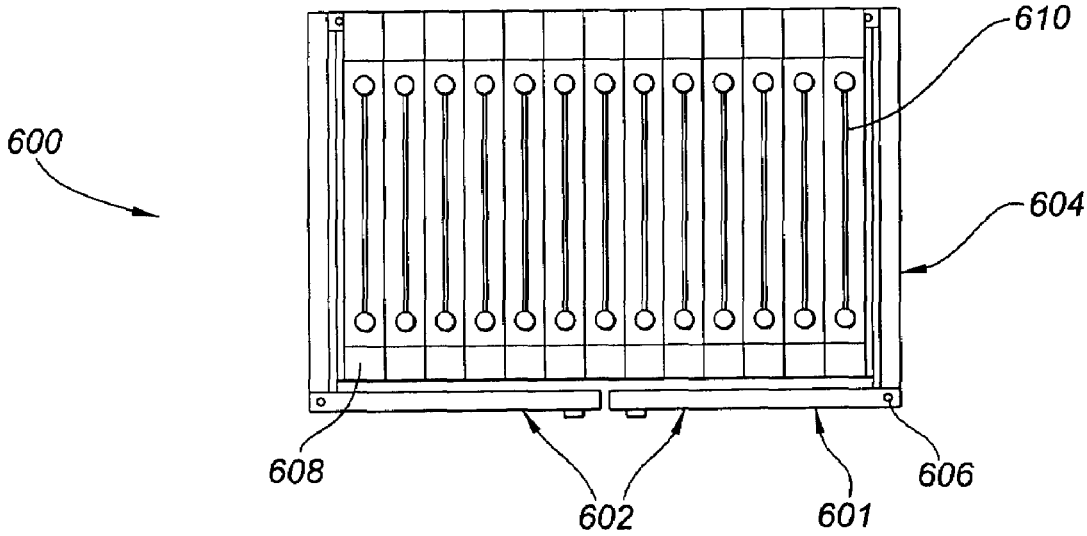
FIG. 16 is a top view of a top section of an organizer according to a preferred embodiment of the present invention.

FIG. 16 is a top view of a top section 600 of a jewelry organizer according to a preferred embodiment of the present invention. In this preferred embodiment, doors 601 are formed by two sections 602, 604 coupled together by a hinge 606. The section 602 of the door 601 can be rotated open and folded back on section 604. In this preferred embodiment, grooves 608 are formed in the bottom of the top section and stands 610 are slid into these grooves 608. In an alternative embodiment, the top section 600 may not have grooves 608 but rather may have at least one earring stand permanently affixed in the top section of the organizer.

Figure 18:
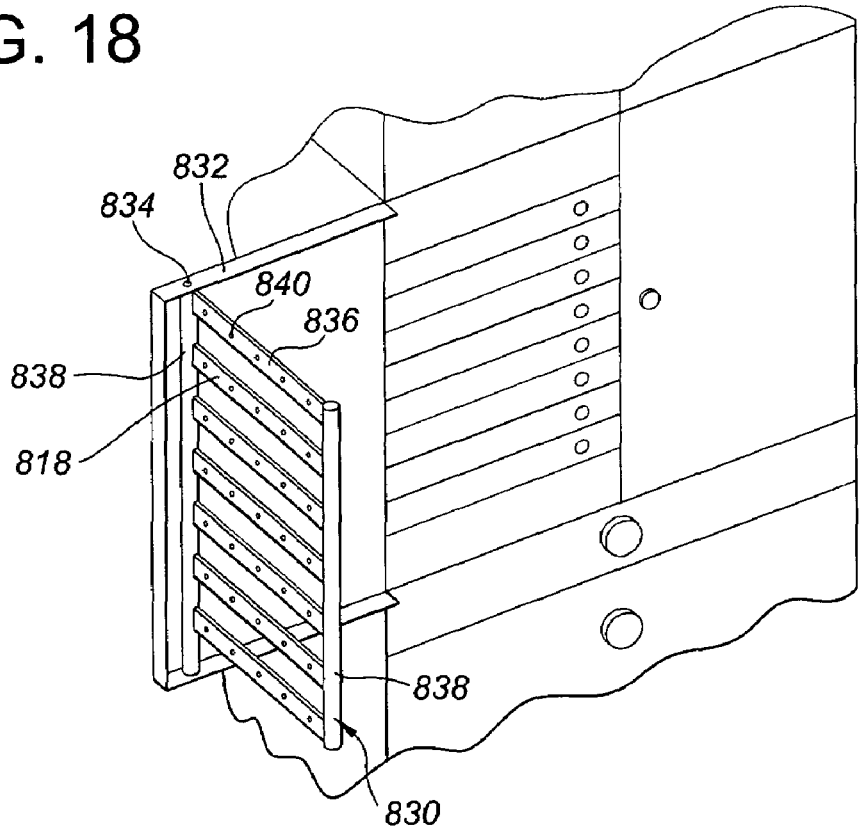
FIG. 18 is a perspective view of a portion of the organizer shown in FIG. 17.
Figure 17:
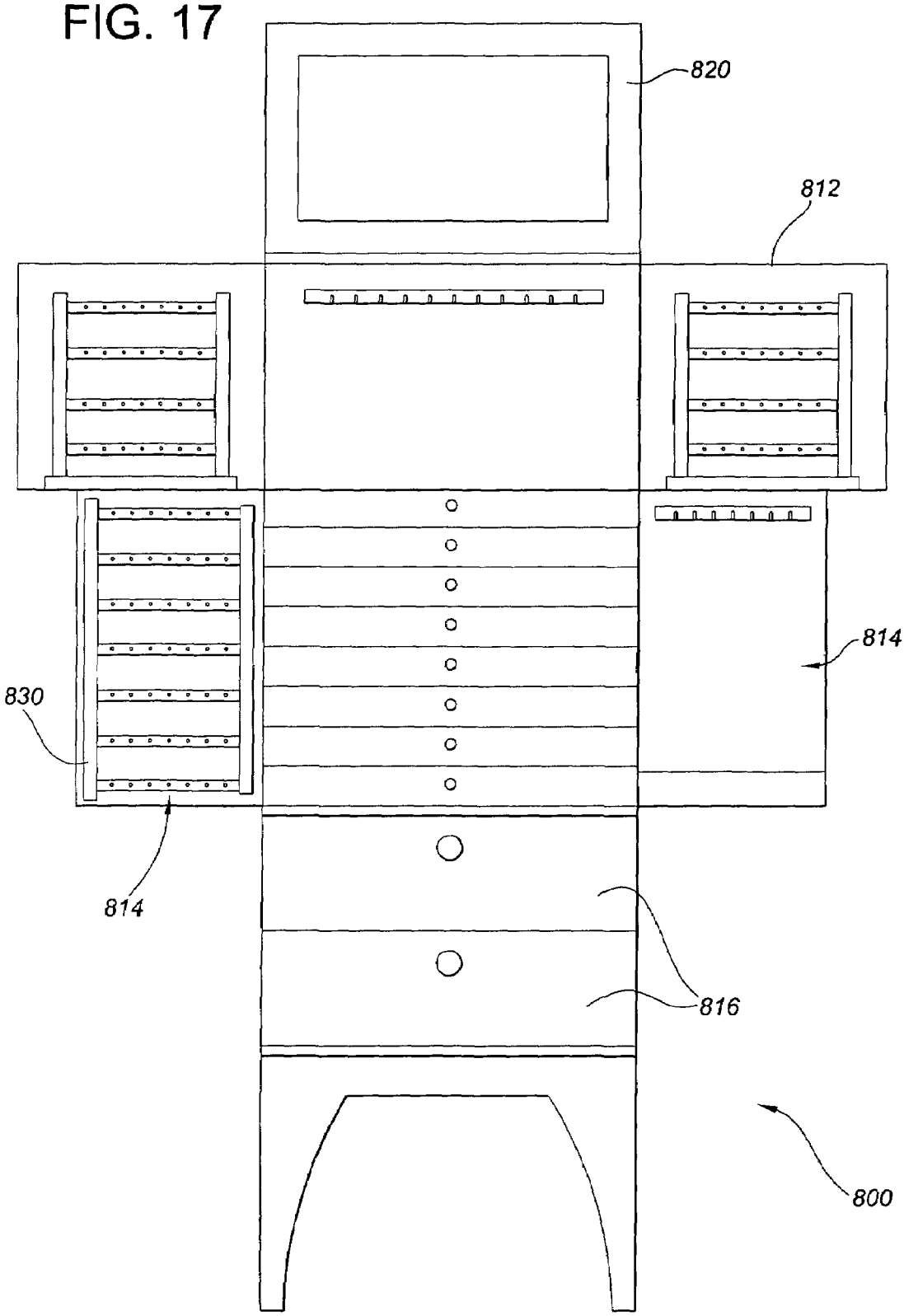
FIG. 17 is a front elevational view of a jewelry organizer according to another preferred embodiment of the present invention.

FIG. 17 is a front elevational view of a jewelry organizer 800 according to another preferred embodiment of the present invention. The organizer 800 has similar features to the organizers already described. The organizer 800 includes an additional earring tree 830 mounted to an inner surface of door 814. The inner surface of the door 814 has a lip 832 (as seen in FIG. 18) that runs around the perimeter of the door 814. The earring tree 830 is mounted on the door 814 by a pin 834 located at the top and bottom of the door 814. The earring tree 830 rotates about the pins 834 so that access to both sides of the earring tree 830 can be had as seen in FIG. 18. Like the earring stands located in the top section of the organizers, the earring tree 830 has a plurality of cross bars 836 extending between pillars 838. Each cross bar 836 has a plurality of holes 840 through which pierced earrings can be mounted. The thickness of the lip 832 around the perimeter of the door 814 is selected so that when the earring tree 830 is in its closed position as shown in FIG. 17, it fits within the recess created by the lip 832. A latch (not shown) may be provided to secure the free end of the earring tree 830 to the inner surface of the door 814.

Figure 19:
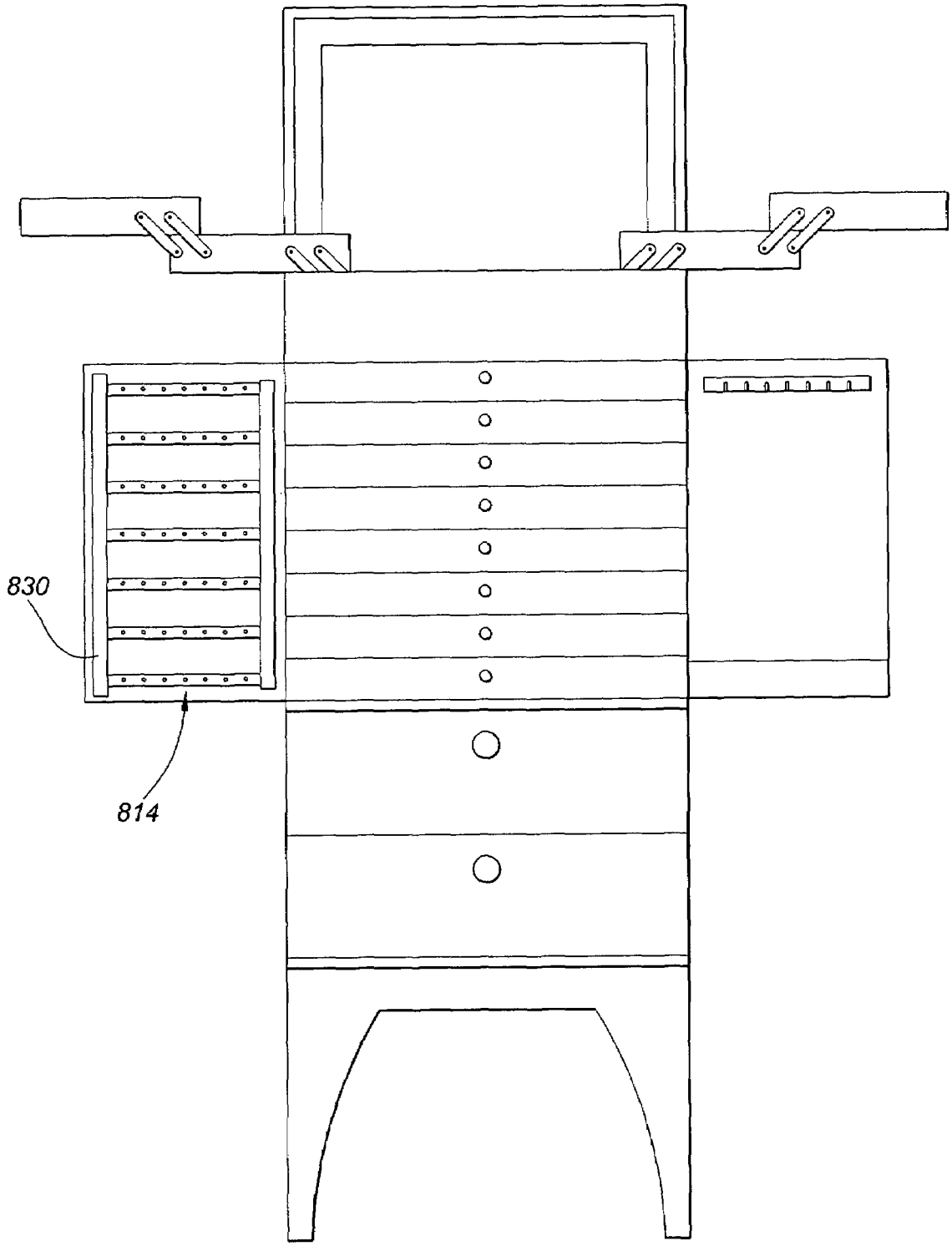
FIG. 19 is a front elevational view of a jewelry organizer according to another preferred embodiment of the present invention.

FIG. 19 is a front elevational view of a jewelry organizer according to another preferred embodiment of the present invention. The organizer is similar to that described with reference to FIG. 11 with the addition of an earring tree 830 to the inner surface of the door 814.

It should be understood that a wide range of changes and modifications can be made to the embodiment described above. It is therefore intended that the foregoing description illustrates rather than limits this invention, and that it is the following claims, including all equivalents, which define the invention.

What is claimed is:

1. An organizer for the storage of jewelry, the organizer comprising:

a top section, the top section including a back wall and a pivoting cabinet rotatably secured to the top section in proximity to back wall, the cabinet including a floor approximately spanning a depth of the top section, the floor including a surface having a depression forming a groove;

a separate first stand having a base which is dimensioned to be slidably received in the groove formed in the cabinet;

a middle section located under the top section, the middle section having at least one drawer and at least one door; and a bottom section located under the middle section for supporting the organizer on a surface.

2. An organizer according to claim 1 further comprising a necklace bar located on an inner surface of the door of the middle section.

3. An organizer according to claim 1 wherein the door in the middle section can be placed in an open state or a closed state wherein when it is placed in an open state the drawer is exposed and when it is in a closed state, the drawer is concealed.

4. An organizer according to claim 1 wherein the top section is detachable from the middle section.

5. An organizer according to claim 1 wherein the middle section is detachable from the bottom section.

6. An organizer according to claim 1 further comprising a necklace rack comprising a plurality of hooks affixed to a back wall of the organizer.

7. An organizer according to claim 1 wherein the stand has a pair of vertical supports extending upwardly from its base and a cross piece extending between the pair of vertical supports.

8. An organizer according to claim 1 wherein the drawer in the middle section houses dividers to create compartments.

9. An organizer according to claim 8 wherein the dividers are removable.

10. An organizer according to claim 8 wherein the dividers are adjustable to customize the interior of the drawer.

11. An organizer according to claim 1 wherein the drawer houses a ring holder.

12. An organizer according to claim 1 wherein at least some portions of internal surfaces in the cabinet and drawer are lined with anti-tarnish cloth.

13. An organizer according to claim 1 wherein the organizer is constructed of wood.

14. An organizer according to claim 1 further comprising a pivoting lid located above the pivoting cabinet of the top section.

15. An organizer according to claim 14 further comprising a mirror disposed on an inner surface of the pivoting lid.

16. An organizer according to claim 14 further comprising a mirror located underneath the pivoting lid, the mirror having an easel-style stand to support the mirror when the pivoting lid is opened.

17. An organizer according to claim 1 wherein the bottom section comprises a plurality of drawers.

18. An organizer according to claim 1 wherein the bottom section comprises a plurality of pivoting trays.

19. An organizer according to claim 1 wherein the bottom section comprises a plurality of legs.

20. An organizer according to claim 1 further comprising a secret compartment.

21. An organizer according to claim 1 wherein the top section further includes a second pivoting cabinet, the second pivoting cabinet rotatably secured to the top section in proximity to the back wall and being symmetrically arranged with respect to the pivoting cabinet.

22. An organizer for the storage of jewelry, the organizer comprising:

a top section, the top section including a back wall and a pivoting cabinet rotatably secured to the top section in proximity to the back wall, the cabinet including a floor approximately spanning a depth of the top section, the floor including a surface having a depression forming a groove;

a separate first stand having a base which is dimensioned to be slidably received in the groove formed in the cabinet; and a middle section, the middle section located under the top section, the middle section having a plurality of drawers stacked one on top of the other and a pair of doors wherein the doors can be pivoted to an open position thereby exposing the plurality of drawers and the doors can be pivoted to a closed position to conceal the plurality of drawers.

23. An organizer according to claim 22 wherein at least one of the pair of doors has a necklace bar located on its inner surface.

24. An organizer according to claim 22 further comprising a bottom section located under the middle section for supporting the organizer on a surface.

25. An organizer according to claim 24 wherein the bottom section comprises a plurality of drawers.

26. An organizer according to claim 24 wherein the bottom section comprises a plurality of legs.

27. An organizer according to claim 22 wherein the top section is detachable from the middle section.

28. An organizer according to claim 22 wherein the middle section is detachable from the bottom section.

29. An organizer according to claim 22 further comprising a necklace rack comprising a plurality of hooks affixed to a back wall of the organizer.

30. An organizer according to claim 22 wherein the stand has a pair of vertical supports extending upwardly from its base and a cross piece extending between the pair of vertical supports and cross piece extending between the pair of vertical supports.

31. An organizer according to claim 22 wherein the drawer in the middle section houses divided compartments.

32. An organizer according to claim 22 wherein the drawer houses a ring holder.

33. An organizer according to claim 22 wherein at least some portions of internal surfaces of the cabinet and drawer are lined with anti-tarnish cloth.

34. An organizer according to claim 22 wherein the organizer is constructed of wood.

35. An organizer according to claim 22 further comprising a pivoting lid located above the pivoting cabinet of the top section.

36. An organizer according to claim 35 further comprising a mirror disposed on an inner surface of the pivoting lid.

37. An organizer according to claim 35 further comprising a mirror located underneath the pivoting lid; the mirror having an easel-style stand to support the mirror when the pivoting lid is opened.

38. An organizer according to claim 22 further comprising a secret compartment.

39. A jewelry organizer comprising:

a back wall;

a first pair of pivoting doors rotatably secured to the organizer in proximity to the back wall, each of the pivoting doors having a cabinet formed therein, each cabinet including a floor, each floor including a surface having a plurality of depressions, each depression forming a groove;

a plurality of separate stands, each stand having a base which is dimensioned to be slidably received in one of the grooves formed in the floor of each cabinet, each stand having a pair of vertical supports extending upwardly from each base and each stand having at least one cross piece extending between the pair of vertical supports; and a drawer located underneath the first pair of pivoting doors further comprising a second pair of pivoting doors located adjacent the drawer.

40. An organizer for the storage of jewelry, the organizer comprising:

a top section, the top section including a first earring stand;

a middle section located under the top section, the middle section including a drawer and a door located adjacent to the drawer, the door including an inner surface having a lip; and a second earring stand, including a cross bar extending between a first pillar and a second pillar, the first pillar rotatably mounted to the lip of the door, wherein the top section has a groove formed therein and the first earring stand has a base which is dimensioned to be slidably received in the groove.

* * * * *